US010542827B2

(12) United States Patent
Cross

(10) Patent No.: US 10,542,827 B2
(45) Date of Patent: Jan. 28, 2020

(54) INFANT ACCOMODATION APPARATUS

(71) Applicant: James Galt & Co. Limited, Cheadle (GB)

(72) Inventor: Sophie Cross, Cheadle (GB)

(73) Assignee: JAMES GALT & CO., LIMITED, Cheadle (GB)

( * ) Notice: Subject to any disclaimer, the term of this patent is extended or adjusted under 35 U.S.C. 154(b) by 166 days.

(21) Appl. No.: 15/571,772

(22) PCT Filed: May 3, 2016

(86) PCT No.: PCT/GB2016/051268
§ 371 (c)(1),
(2) Date: Nov. 3, 2017

(87) PCT Pub. No.: WO2016/178014
PCT Pub. Date: Nov. 10, 2016

(65) Prior Publication Data

US 2018/0140111 A1 May 24, 2018

(30) Foreign Application Priority Data

May 6, 2015 (GB) ..... 1507749.8

(51) Int. Cl.
*A47D 13/08* (2006.01)
*A47D 15/00* (2006.01)

(52) U.S. Cl.
CPC ..... *A47D 13/08* (2013.01); *A47D 15/008* (2013.01)

(58) Field of Classification Search
None
See application file for complete search history.

(56) References Cited

U.S. PATENT DOCUMENTS 1,392,533 A * 10/1921 Smyth ..... B63B 7/082 114/345
3,058,122 A 10/1962 McDaniel et al.
(Continued)

FOREIGN PATENT DOCUMENTS

GB 0646678 A 11/1950
GB 2284546 A 6/1995
(Continued)

OTHER PUBLICATIONS

GB Search Report for G92536086, dated Oct. 13, 2015 (2 pgs.).
International Search Report and Written Opinion for PCT/GB2016/051268, dated Jul. 11, 2016 (10 pgs.).

*Primary Examiner* — Sarah B McPartlin
(74) *Attorney, Agent, or Firm* — Shumaker, Loop & Kendrick, LLP

(57) ABSTRACT

An infant accommodation apparatus comprising an inflatable support device and a frame which abuts and extends over the device and includes toys arranged to stimulate an infant accommodated within an accommodation region of the device. The device maybe inverted to reveal a second infant accommodation region which is arranged to provide a safe and secure environment for a baby from birth. A region includes a padded headrest and a body support region. A harness is provided and arranged to receive a baby's legs. In use, a baby can be placed on a region, with its head resting in a region of a headrest and safely secured in position by engagement with the harness.

16 Claims, 10 Drawing Sheets

(56) References Cited

U.S. PATENT DOCUMENTS

| | | | | |
|---|---|---|---|---|
| 4,964,183 | A | 10/1990 | LaForce, Jr. | |
| 5,813,066 | A | 9/1998 | Gebhard et al. | |
| 5,930,854 | A * | 8/1999 | O'Neill | A47D 13/063 135/135 |
| 6,354,665 | B1 * | 3/2002 | Ross | A47C 4/54 297/250.1 |
| 6,499,165 | B1 * | 12/2002 | Morgillo | A47D 13/08 5/490 |
| 6,553,590 | B1 * | 4/2003 | Leach | A47D 13/08 5/655 |
| 2005/0000023 | A1 | 1/2005 | Brown et al. | |
| 2009/0193589 | A1 | 8/2009 | Carr et al. | |
| 2010/0029170 | A1 * | 2/2010 | Hall | A47D 13/06 446/227 |

FOREIGN PATENT DOCUMENTS

| | | | |
|---|---|---|---|
| WO | 2014074916 | A2 | 5/2014 |
| WO | 2014074916 | A3 | 5/2014 |

* cited by examiner

INFANT ACCOMODATION APPARATUS

TECHNICAL FIELD AND BACKGROUND OF THE INVENTION

The invention relates to an infant accommodation apparatus.

Numerous types of apparatus for accommodating and/or entertaining infants are known. For example, playpens comprise an enclosure wall supported on the floor within which an infant is placed. Another known apparatus comprises a pair of soft foam semi-circles secured together in order to define a circular area for accommodating an infant.

GB2284546 (Galt) relates to a device for accommodating an infant which comprises an inflatable ring which can be adjusted in volume to vary the space available to the child and a cover releasably attachable to the ring. The device may be arranged in a fully inflated condition wherein the ring is relatively rigid. In this case, the device is said to be suitable for use by relatively old infants, for example aged between 1 and 4 years who may sit or crouch within a safe environment and play with various features associated with the cover. In an alternative condition, it is stated that the ring may be inflated to about 60-70% of the maximum inflation wherein the ring is relatively flaccid. In this case, the device is said to be suitable for infants, between the ages of 0 and 1, who may be laid across the device in a resting position. However, this arrangement is not always satisfactory, and in some cases may be dangerous, particularly as the baby becomes more mobile, since the infant may squirm and become dislodged from its protective position. It is an object of the present invention to address this problem.

BRIEF SUMMARY OF THE INVENTION

In general terms, it is an object of the present invention to provide a versatile infant accommodation apparatus which may be used safely from birth and for several years thereafter.

According to a first aspect of the invention, there is provided infant accommodation apparatus comprising a support device which includes a base, said support device including an enclosure extending away from said base on a first side of the base, wherein said enclosure surrounds an infant accommodation region in which an infant may be positioned in use and wherein a headrest is provided on a second side of the base.

Said infant accommodation apparatus is suitably arranged to be positioned in a first configuration wherein the base directly contacts and/or is supported by a support surface, for example a floor. The base preferably makes face to face contact with the support surface. In the first configuration, said enclosure suitably extends upwardly away from the base on said first side. Thus, in this case, said enclosure preferably defines an upstanding enclosure of the support device. In said first configuration, said first side suitably faces upwardly and said second side faces downwardly.

Said enclosure of said support device is preferably resilient and/or cushioning and/or deformable. Said enclosure is preferably defined by means of an inflated member which inflated member can preferably be deflated.

Said support device preferably includes an outer surface provided in a multiplicity of colours. Tactile sense stimulation means and/or auditory sense stimulation means may be associated with said surface.

Said support device is preferably arranged to define an endless enclosure around the region for accommodating an infant. Said support device is preferably arranged to be of substantially constant cross-section along its extent. It is preferably substantially circular in cross-section.

The support device may be arranged to define a first condition. In said first condition, said support device may have a first volume. In this case, said support device is preferably relatively rigid. Preferably, also, said support device is cushioning and/or deformable when in said first condition. The device may be arranged to define a second condition. In said second condition, said support device may have a second volume. Said second volume is preferably less than said first volume. Said second volume suitably represents the minimum volume of said support device. Said second condition of the device suitably represents a storage condition of the device.

When the device is in said first condition, it may be inflated to 80-100% of its maximum volume. When the device is in said second condition, it is preferably substantially deflated.

Said support device preferably incorporates a cover which is preferably removable from an insert member of the device. Said insert member preferably provides the resilient and/or cushioning and/or deformable properties of the support device. Said insert member is preferably said inflated member.

Said cover is preferably arranged to cover substantially the whole of said insert member. Said cover is preferably flexible. Said cover is preferably non-self-supporting. The cover is preferably made out of a fabric which is preferably washable.

Said cover preferably has an internal region in which the insert member is accommodated. A cover opening is suitably provided in said cover means for allowing access to said internal region. Closure means, for example in the form of a zip fastener, may be provided for closing said cover opening.

When in said first configuration, an infant may suitably be positioned within the infant accommodation region in a kneeling or sitting position.

When said apparatus is in said first configuration, said headrest preferably faces downwardly. In said first configuration, said headrest preferably directly contacts a support surface, for example a floor, on which the infant accommodation apparatus may be arranged, in use. Thus, in said first configuration, said second side of the base may be an underside of the base.

When said support device includes a cover as described, said headrest is preferably secured to the cover. It is preferably permanently secured to the cover. For example, it may be sewn to the cover.

Said headrest preferably includes a first part which is arranged to contact and/or seat the back of an infant's (e.g. a baby of 0 to 1 years old) head, in use. The first part may have a curved outer perimeter. The headrest preferably includes a proud region which extends around the first part and is suitably arranged to restrict side to side movement of the infant's head in use. A portion of the proud region may be provided on opposite sides of the first part. The proud region may extend around the first part. The proud region is preferably cushioned. The headrest is preferably arranged to restrict movement of the infant and/or support the infant's head, in use.

Said headrest is preferably superimposed on a region of the support device which is outside an area occupied by the infant accommodation region.

Preferably, a harness is provided on a second side of the base for securing an infant to the support device.

When said apparatus is in said first configuration, said harness preferably faces downwardly. In said first configuration, said harness preferably directly contacts a support surface, for example a floor, on which the infant accommodation apparatus may be arranged in use.

When said support device includes a cover as described, said harness is preferably secured relative to the cover. It is preferably permanently secured relative to the cover. For example, it may be sewn to the cover and/or to an infant support part which is secured to the cover.

Said harness may include means defining two openings for receiving the legs of an infant in use. The harness may include a crotch part which is suitably arranged to extend between the infant's legs. The crotch part is preferably secured, for example substantially permanently secured, relative to a cover of the device. The crotch part suitably extends from its position of securement to a waist/hips-contacting part of the harness. First and second ends of the waist/hips-contacting part are suitably secured in position, for example permanently, at spaced apart positions.

Said harness is preferably superimposed on the infant accommodation region of the support device.

Said infant accommodation apparatus is suitably arranged to be positioned in a second configuration which is suitably inverted relative to said first configuration. Thus, in said second configuration, said first side suitably faces downwardly and said second side faces upwardly. Preferably in said second configuration, said headrest (and said harness when provided) face(s) upwardly. In said second configuration, said headrest (and said harness when provided) is/are associated with an uppermost surface of the support device. In said second configuration, an outer face of said enclosure wall of said support device suitably abuts a support surface, for example the floor.

When in said second configuration, said infant accommodation region may be substantially inaccessible, since a mouth (which when in said first configuration defines an opening allowing access to said region) abuts a support surface, for example the floor.

In a preferred embodiment, said support device includes an infant support part which suitably defines an area for supporting an infant's body when the support device is in its second configuration. Said infant support device may comprise a shaped material which may be secured to the cover. Said infant support device is preferably cushioned and/or it may incorporate wadding. Said harness is preferably attached to said infant support part.

The support device may be arranged such that, when in said second configuration with an infant contacting said infant support part, a concave region is defined (i.e. by virtue of the weight of the infant) in which an infant (e.g. aged 0 to 1) lies. When said support device includes a cover and/or an infant support device said concave region may be defined, at least in part, by said cover and/or infant support device. For example, the cover and/or infant support device may be flexible. Preferably, the concave region is defined inwards of said enclosure.

When in said second configuration, an infant may be positioned in the device with its posterior as described, its head in contact with the headrest and secured in position by a harness (when provided as described). The headrest and harness are preferably diametrically spaced apart on opposite sides of the infant accommodation region.

In a first preferred embodiment, the support device includes an enclosure having inner and outer walls in the shape of equilateral triangles as described in the specific embodiments which follow. Thus, in the first preferred embodiment, said support device includes an inwardly facing non-circular upstanding enclosure wall (hereinafter referred to as the "inner enclosure wall") which surrounds an infant accommodation region in which an infant may be positioned in use.

Said inner enclosure wall is preferably endless, suitably for defining an endless enclosure around the infant accommodation region.

Said inner enclosure wall is preferably curved to define a curved infant accommodation region. That is, said inner enclosure wall suitably curves in a horizontal plane (which plane is suitably parallel to a support surface, for example a floor, on which the apparatus may be supported.

Said inner enclosure wall preferably includes a first region which has a smaller radius of curvature than respective second and third regions of said inner enclosure wall adjacent to said first region. Said inner enclosure wall preferably includes a fourth region which is adjacent said second region, wherein said fourth region has a radius of curvature which is less than that of said second region. Said inner enclosure wall preferably includes a fifth region which is adjacent said third region, wherein said fifth region has a radius of curvature which is less than that of said third region. Said enclosure wall preferably has a sixth region between said fourth and fifth regions, wherein said sixth region has a radius of curvature which is greater than the radius of curvature of said fourth and fifth regions.

When said inner enclosure wall includes first, fourth and fifth regions, the radii of curvature of said regions are preferably substantially the same. Preferably, the lengths of said first, fourth and fifth regions are substantially the same. The radii of curvature of each of said first, fourth and fifth regions are preferably less than the radii of curvature of each of said second, third and sixth regions When said inner enclosure wall includes second, third and sixth regions, the radii of curvature of said regions are preferably substantially the same. Preferably, the lengths of said second, third and sixth regions are substantially the same. The radii of curvature of each of said second, third and sixth regions are preferably greater than the radii of curvature of each of said first, fourth and fifth regions.

Said inner enclosure wall is preferably substantially symmetrical about each of three vertical planes angled at 120° to each other.

Said inner enclosure wall is preferably substantially in the shape of a modified triangle, for example a modified equilateral triangle. The wall suitable includes three curved apex regions (which are suitably said first, fourth and fifth regions described) separated by curved side regions (which are suitably said second, third and sixth regions described).

The maximum diameter of the inner enclosure wall may be in the range 20 to 50 cm, preferably 25 to 40 cm, more preferably 30 to 40 cm.

Said support device suitably includes an outwardly facing non-circular upstanding enclosure wall (hereinafter referred to as the "outer enclosure wall").

Said outer enclosure wall is preferably endless, suitably for defining an endless outer wall of the support device.

Said outer enclosure wall is preferably curved to define a curved outer wall of the support device. That is, said outer enclosure wall suitably curves in a horizontal plane (which plane is suitably parallel to a support surface, for example a floor, in which the apparatus may be supported).

Said outer enclosure wall preferably includes a first region which has a smaller radius of curvature than respective second and third regions of said outer enclosure wall adjacent to said first region. Said outer enclosure wall preferably includes a fourth region which is adjacent said second region, wherein said fourth region has a radius of curvature which is less than that of said second region. Said enclosure wall preferably includes a fifth region which is adjacent said third region, wherein said fifth region has a radius of curvature which is less than that of said third region. Said outer enclosure wall preferably has a sixth region between said fourth and fifth regions, wherein said sixth region has a radius of curvature which is greater than the radius of curvature of said fourth and fifth regions.

When said outer enclosure wall includes first, fourth and fifth regions, the radii of curvature of said regions are preferably substantially the same. Preferably, the lengths of said first, fourth and fifth regions are substantially the same. The radii of curvature of each of said first, fourth and fifth regions of said outer enclosure wall are preferably less than the radii of curvature of each of said second, third and sixth regions.

When said outer enclosure wall includes second, third and sixth regions, the radii of curvature of said regions are preferably substantially the same. Preferably, the lengths of said second, third and sixth regions are substantially the same. The radii of curvature of each of said second, third and sixth regions are preferably greater than the radii of curvature of each of said first, fourth and fifth regions.

Said outer enclosure wall is preferably substantially symmetrical about each of three vertical planes angled at 120° to each other.

Said outer enclosure wall is preferably substantially in the shape of a modified triangle, for example a modified equilateral triangle. The outer wall suitable includes three curved apex regions (which are suitably said first, fourth and fifth regions described) separated by curved side regions (which are suitably said second, third and sixth regions described).

Said inner and outer enclosure walls preferably extend substantially parallel to one another across substantially their entire extent. Said support device preferably has a substantially constant cross-section (suitably the cross-section in a vertical plane) along its extent. Said cross-section is preferably curved; it is preferably substantially circular or oval-shaped.

Said support device preferably has first and second maximum diameters (i.e. the two largest distances across the support device) which extend in respective first and second directions in a horizontal direction, wherein said first and second directions extend at an angle in the range 95 to 145°, preferably 110 to 130°, especially about 120°, to one another. Said support device preferably has a third maximum diameter (i.e. the third largest distance) which extends in a third direction, wherein said third direction extends at an angle in the range 95 to 145°, preferably 110 to 130°, especially about 120°, to each of said first and second directions.

Said first maximum diameter may be in the range 70 to 100 cm, preferably 75 to 95 cm. Said second maximum diameter may be in the range 70 to 100 cm, preferably 75 to 95 cm. Said third maximum diameter may be in the range 70 to 100 cm, preferably 75 to 95 cm.

The support device may have a maximum height in the range 10 to 35 cm, preferably 15 to 30 cm.

In said first preferred embodiment, said headrest is preferably positioned between parts of the inner and outer enclosure wall which have a greater radius of curvature than other parts of the inner and outer enclosure walls. For example, said inner enclosure wall may include a first region which has a smaller radius of curvature than respective second and third regions of said inner enclosure walls adjacent to said first region; and said outer enclosure wall may include a first region which has a smaller radius of curvature than respective second and third regions; and said headrest is preferably positioned between said second region of said inner enclosure wall and a second region of said outer enclosure wall. This is illustrated in FIG. 8 in a specific example.

In said first preferred embodiment when said support device includes a harness, said harness is preferably positioned in line with parts of the inner and outer enclosure walls which have a smaller radius of curvature than other parts of the inner and outer enclosure walls. For example, as described above, said inner enclosure wall may include a fifth region, adjacent the third region, which has a radius of curvature which is less than that of a third region of the inner enclosure wall; and may include an outer enclosure wall which includes a fifth region, adjacent the third region, which has a radius of curvature which is less than that of the third region of the outer enclosure wall, wherein said harness is positioned in line with the fifth regions of the inner and outer enclosure walls.

Said infant accommodation apparatus may include a frame extending above the support device for visually stimulating an infant positioned in the device.

Said support device preferably includes first securement means for securing said frame in position. Said first securement means preferably is arranged on an outwardly, preferably generally radially outwardly, facing surface of the support device. Said support device is preferably spaced from a base of said support means (which base is arranged to abut a support surface in use), suitably by a distance which is greater than one quarter, preferably greater than one third, of the height of the support device. Preferably, said support means is arranged approximately halfway between the base and a top of the support device.

Said first securement means preferably defines a female element for receiving a male portion of said frame. Said first securement means preferably comprises a loop. Said loop is preferably an integral part of said cover means when provided.

Said support device preferably includes a plurality of first securement means. At least three, preferably four, first securement means may be provided. The or each first securement means is preferably provided on the periphery of the support device.

The top of said frame may extend above the support device to a position which is spaced from said support device by a distance which is greater preferably by a factor of at least two, more preferably at least three, than the height of said support device.

Said frame preferably includes at least two, more preferably at least three, limbs extending upwardly from said support device. In an especially preferred embodiment, four limbs are provided. Each of said limbs is preferably curved and preferably extends to an apex region of the frame which apex region is preferably positioned substantially centrally above the support device. The or each limb preferably abuts a region, preferably a curved region, of the support device and is suitably positioned outside the periphery of the support device. By arranging the limb(s) against a curved region, the frame may be stabilized and held relatively rigidly against the support device.

Said limbs of said frame preferably include plastics members. Said limbs are preferably resilient. Said limbs, for example said plastic members when provided, are preferably provided with a cover.

Said frame preferably includes means for securing, preferably releasably securing, stimulation means, suitably in the form of toys. One of said stimulation means is preferably a mirror. Said means for securing may comprise male or female elements arrangements to cooperate with the other one of a male or female element associated with said stimulation means. Preferably, said male or female element is associated with said cover of the frame.

Securement means for securing the frame in position, for example said first securement means, may be arranged to releasably engage the frame when the infant accommodation apparatus is in each both of said first and second configuration as described above.

In a second aspect, there is provided a method of assembling an infant accommodation apparatus of the first aspect which comprises selecting a support device as described and positioning the support device on a support surface so a headrest of the support device faces upwardly. Optionally, a frame as described may be positioned over the support device, suitably so that it extends above the headrest.

In a third aspect, there is provided a method of assembling an infant accommodation apparatus of the first aspect which comprises selecting a support device as described and positioning the support device on a support surface so that a headrest of the support device faces downwardly and/or abuts the support surface.

The invention extends to a kit for assembly of an infant accommodation apparatus or for use in the method described, the kit comprising means for defining a support device and, optionally, means for defining a frame means.

Any feature of any aspect of any invention or embodiment described herein may be combined with any feature of any aspect of any other invention or embodiment described herein mutatis mutandis.

BRIEF DESCRIPTION OF THE DRAWING

Specific embodiments of the invention will now be described, by way of example, with reference to the accompanying drawings, in which.

DETAILED DESCRIPTION OF THE INVENTION

Figure 1:
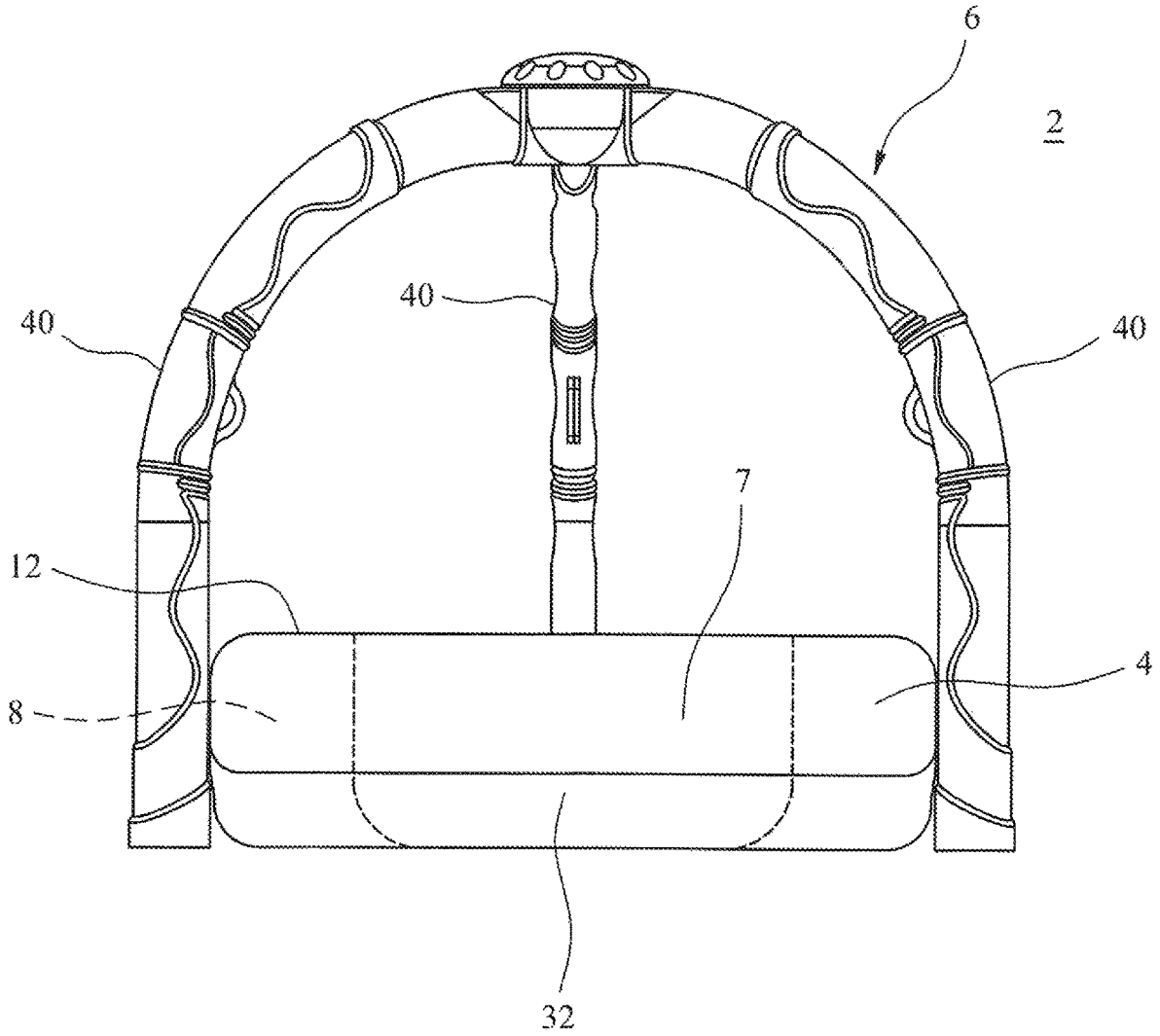
FIG. 1 is a side view of a first embodiment of an infant accommodation apparatus.

In the figures, the same or similar parts are annotated with the same reference numerals.

In the first embodiment, the infant accommodation apparatus 2 comprises an inflatable support device 4 and a framework 6 which abuts and extends over the device 4 and includes toys (not shown) arranged to stimulate, for example to visually stimulate, an infant accommodated within an accommodation region 7 of the device.

The apparatus 2 is described in greater detail below.

The support device 4 comprises an inner inflatable plastics member 8 and an outer removable fabric cover 12 which is arranged to completely enclose the member 8. The support device incorporates a padded base part 14 (FIG. 5) upon which the infant may lie, kneel or sit within the accommodation region 7.

Figure 3:
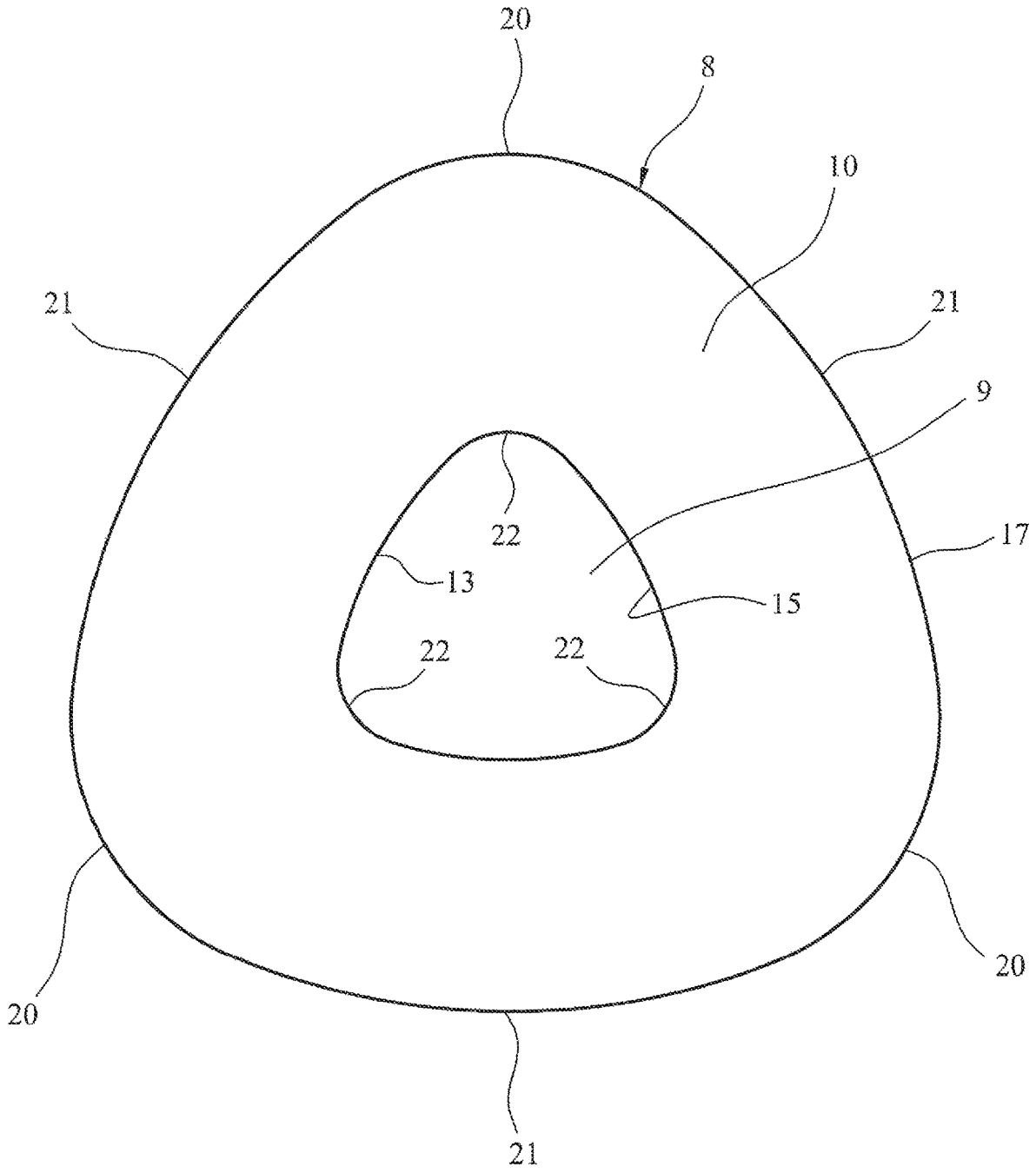
FIG. 3 is a top plan view of an inflatable plastics member of the apparatus when in a deflated state.
Figure 6:
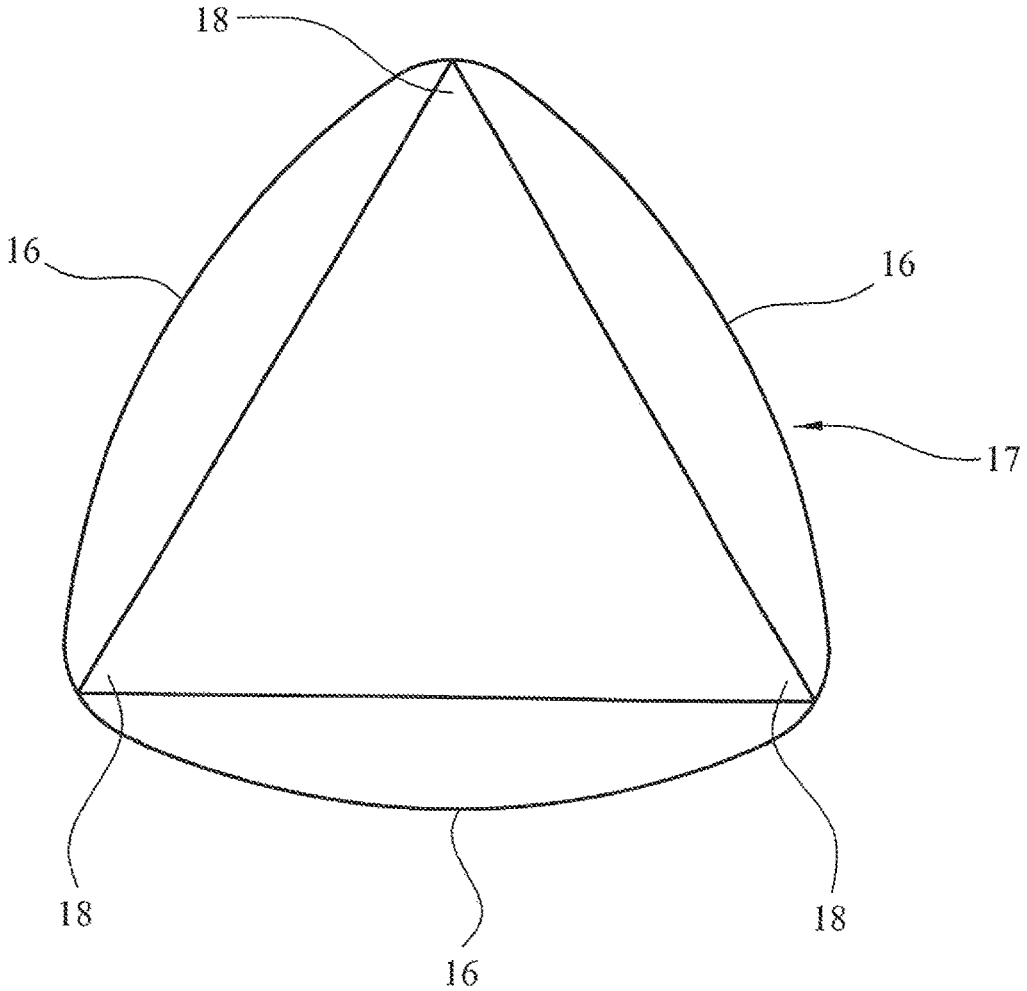
FIG. 6 is a plan view relating the shape of the outer periphery of the plastics member to an equilateral triangle.
Figure 7:
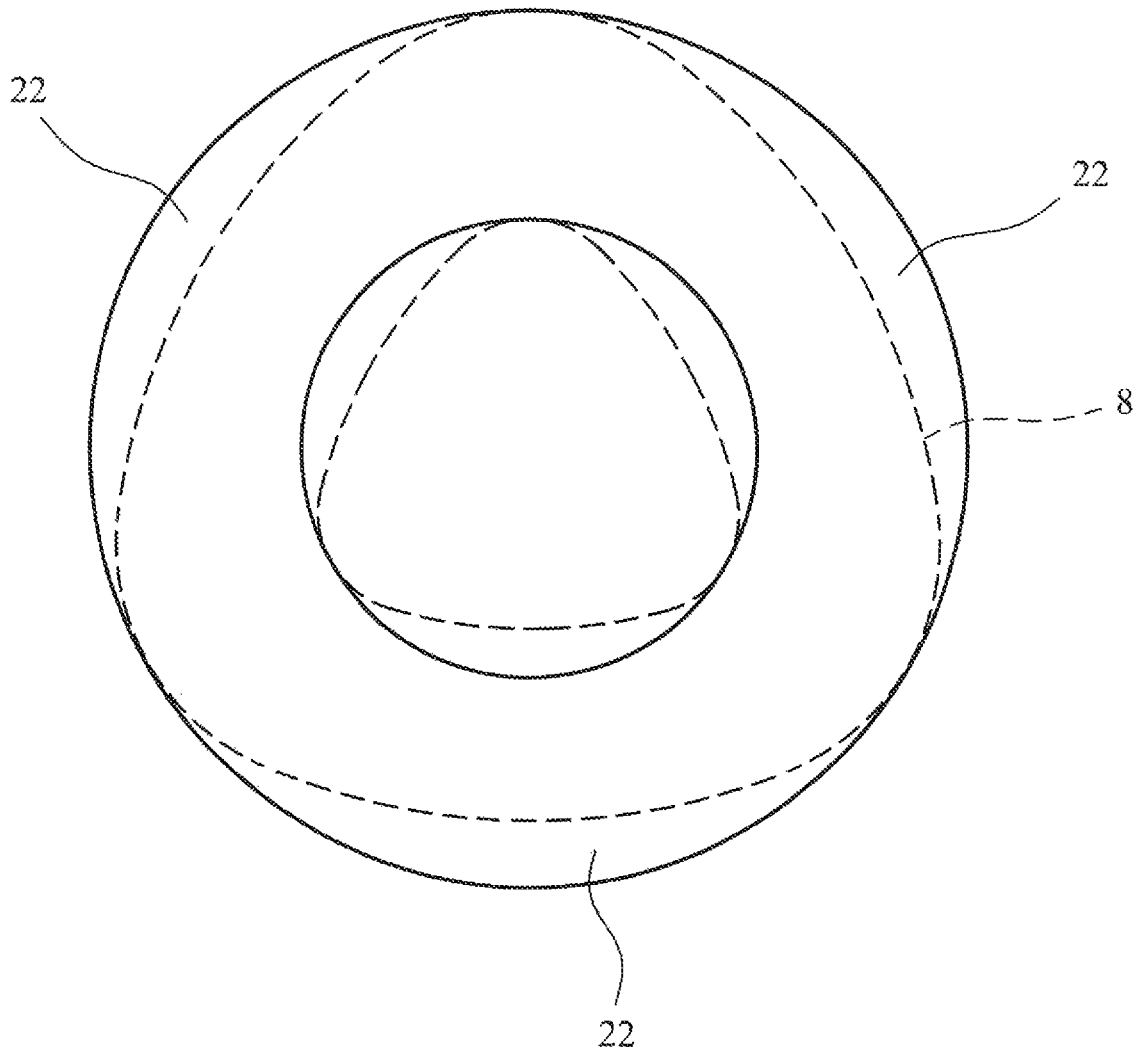
FIG. 7 is a plan view showing in dashed lines the plastics member of FIG. 3 superimposed on a circular member.

Referring to FIG. 3, the plastics member 8 includes an enclosure wall 10 which defines an opening 9 which, when member 8 is inflated, defines the infant accommodation region 7. The enclosure wall 10 has respective parallel inner and outer walls 15, 17 in the shape of modified equilateral triangles. This is illustrated in FIG. 6 wherein three convex arcs 16 are shown extending between adjacent apexes 18 of an equilateral triangular in order to form the shape of the outer wall 17. Thus, outer wall 17 of the member 8 may be regarded as being of a modified triangular shape having three curved apex regions 20 each of which has a radius of curvature which is less than the radius of curvature of the outer wall at apex regions 21 between the apex regions 20. The inner wall 15 corresponds in shape to that of the outer wall 17 so the opening 9 defined by the inner wall 15 comprises three regions 22 (FIG. 7) having a radius of curvature which is less than the radius of curvature of regions of the opening between the apex regions.

The plastics member 8 is preferably made from a plastics material which does not contain phthalates.

Figure 4:
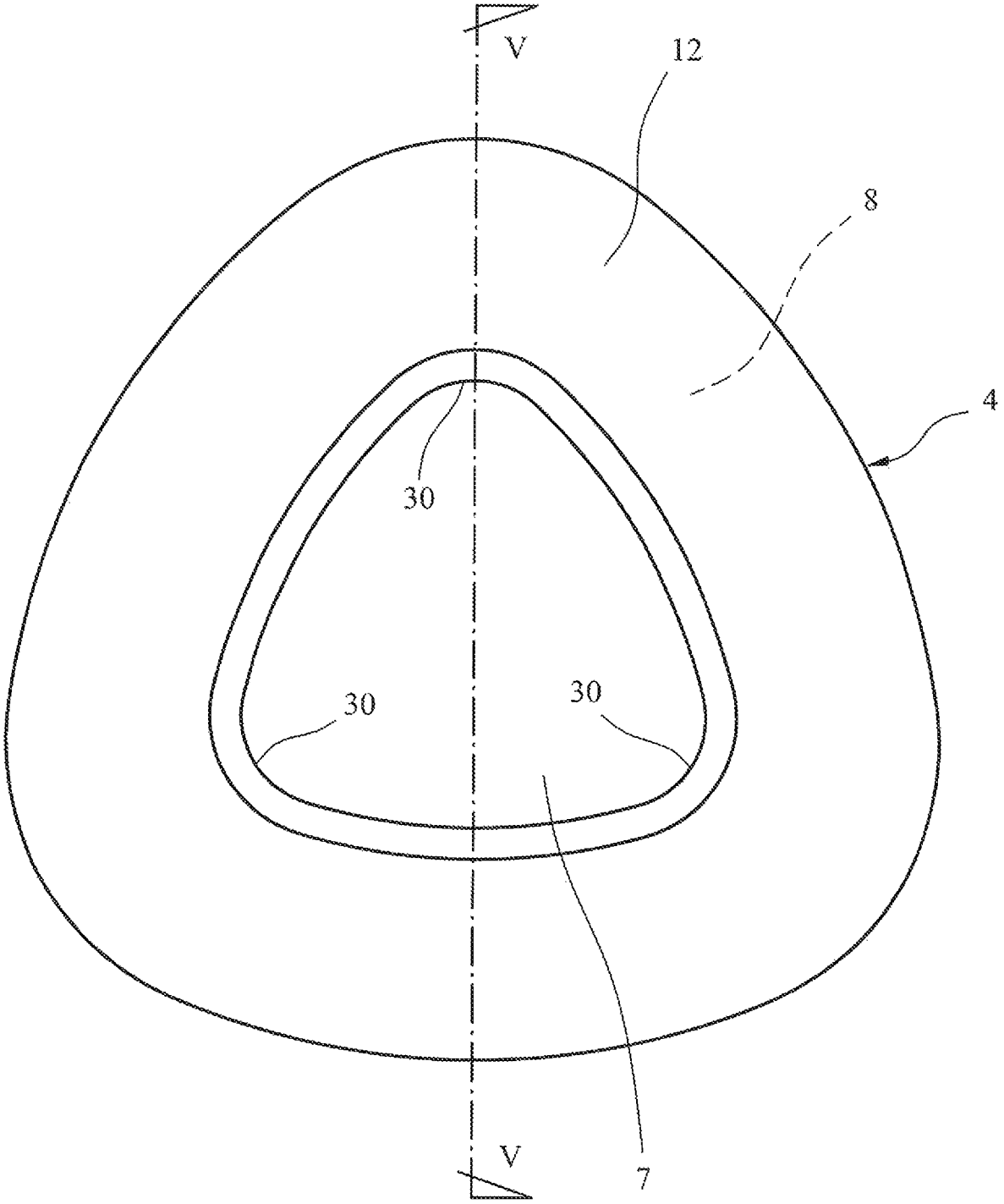
FIG. 4 is a top plan view of a support device which comprises an inflatable plastics member in an inflated state within a fabric cover.
Figure 5:
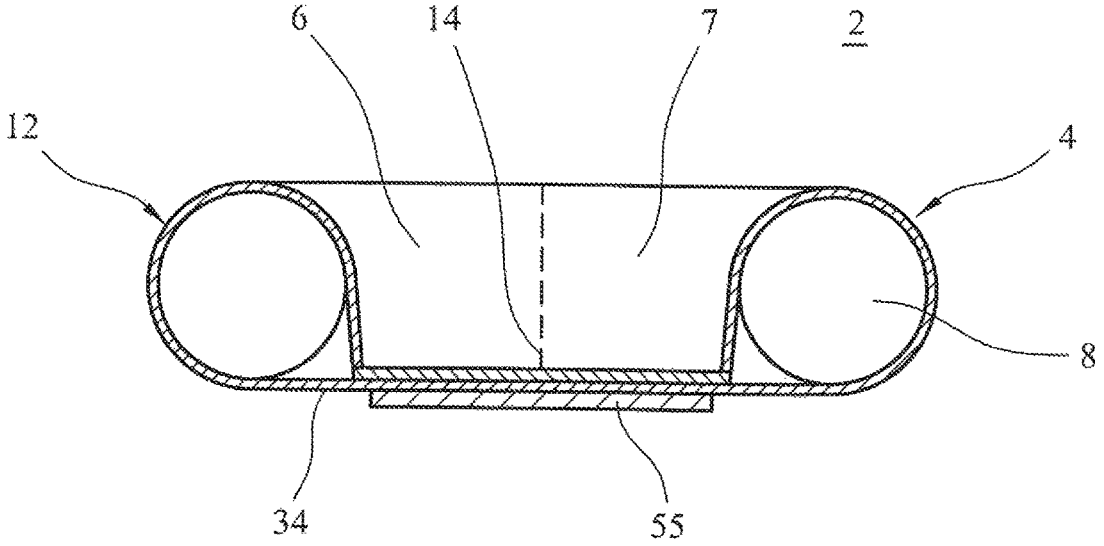
FIG. 5 is a cross-section along line V-V of FIG. 4.

The fabric cover 12 is shaped to snugly receive the plastics member 8 so that when the member 8 is arranged within it, the shape of the support device 4 substantially corresponds to that of the plastic member 8, as shown in FIGS. 4 and 5. Thus, the region 7 is in the shape of a modified equilateral triangle with apex regions 30 having a lower radius of curvature compared to the radius of curvature of regions between the apex regions.

The cover 12 includes a zip 32 (FIG. 1) arranged to define an opening through which the plastics member 8, in a partially deflated state, may be inserted for engagement with the cover. The member 8 may then be inflated to define the arrangement of FIG. 1. It should be appreciated that the padded base 14 of FIG. 5 is not secured to the underlying fabric 34 so that the plastic member 8 can pass between base 14 and fabric 34 when it is being positioned within the cover.

When assembled, the support device 4 provides a safe, supportive environment for an infant who may sit or kneel within accommodation region 7. It will be appreciated that the infant is prevented from falling back by the support provided by the walls of the device.

Figure 8:
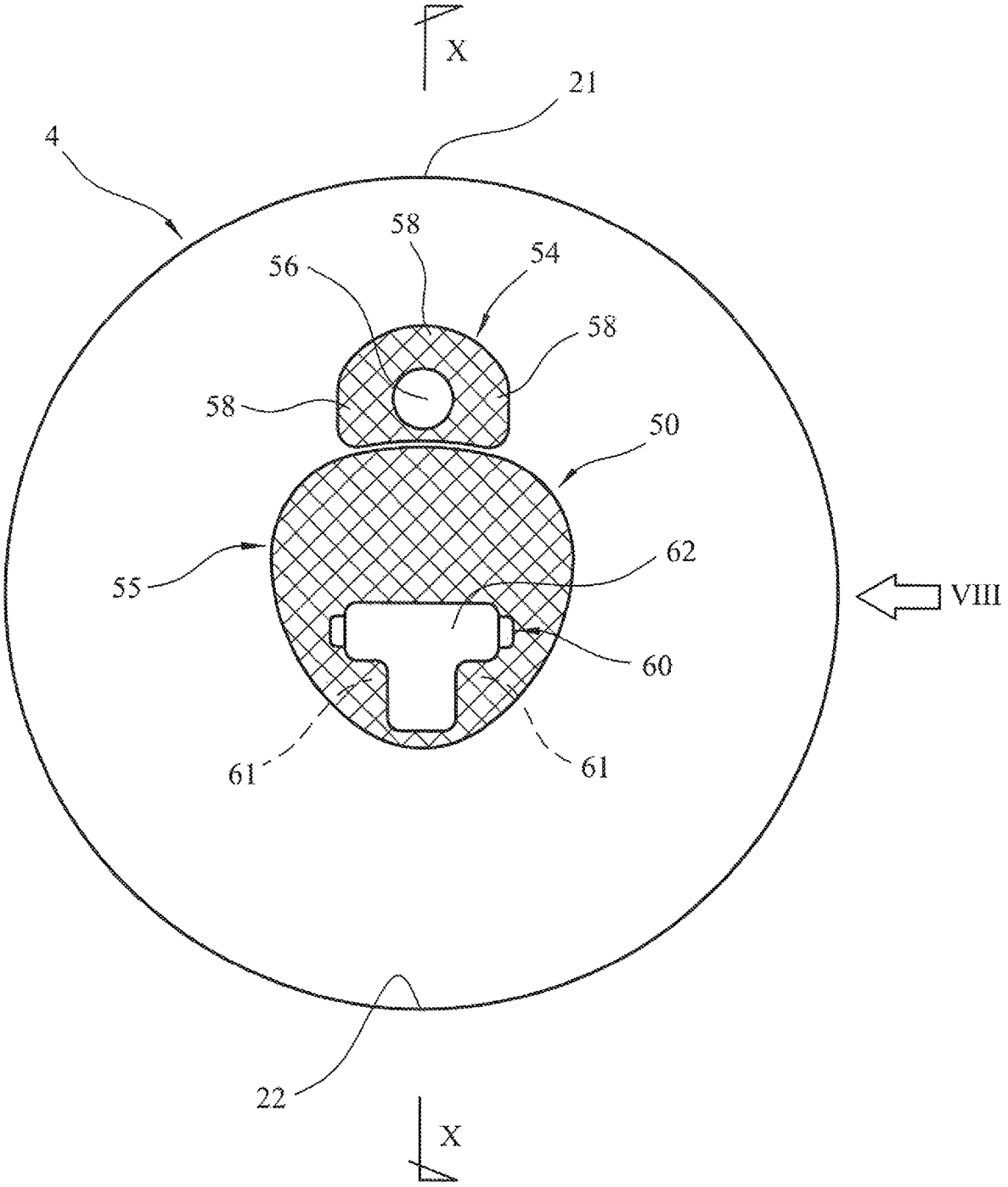
FIG. 8 is a bottom plan view of the support device of FIGS. 4 and 5.
Figure 9:
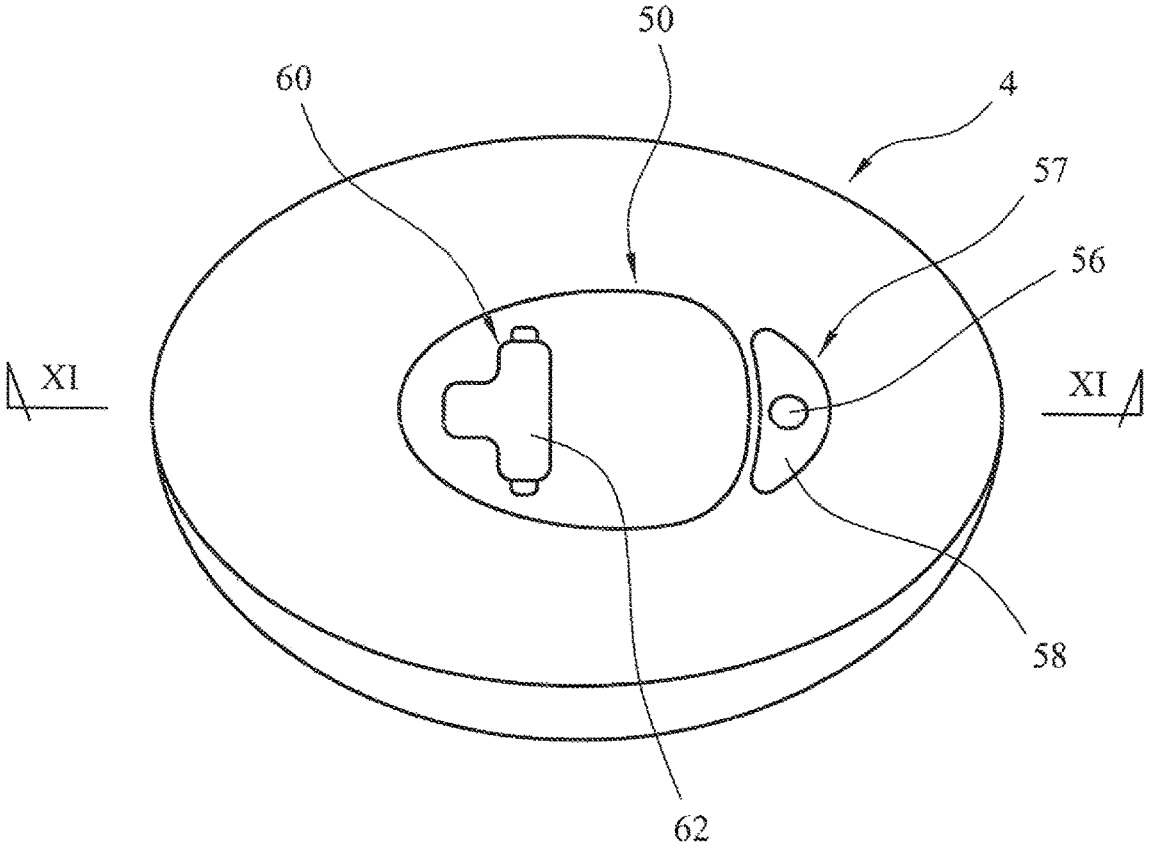
FIG. 9 is a side elevation of the support device of FIG. 8 taken in the direction of arrow VIII. The device is in an inverted configuration compared to its configuration in FIGS. 1 and 2, so the usually bottom wall of the device facing upwardly.
Figure 10:
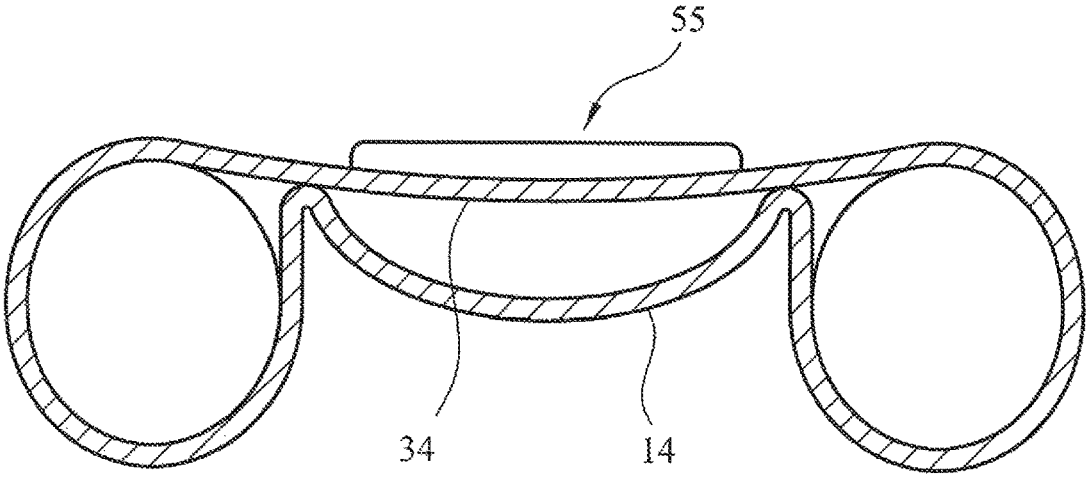
FIG. 10 is a cross-section along line X-X of FIG. 8.
Figure 11:
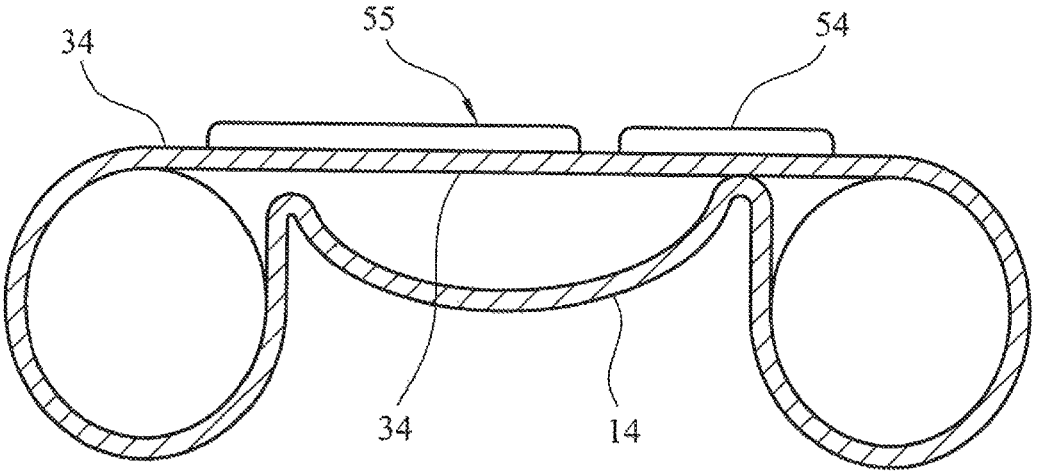
FIG. 11 is a cross-section along line XI-XI of FIG. 9.

The infant accommodation apparatus is furthermore provided with an additional safe environment which may safely accommodate babies from age 0 who cannot support their necks. The additional safe environment is described below with reference to FIGS. 8 and 11.

Note that all of the features shown in FIGS. 8 to 11 are not necessarily shown in other figures, in the interests of clarity.

Figure 2:
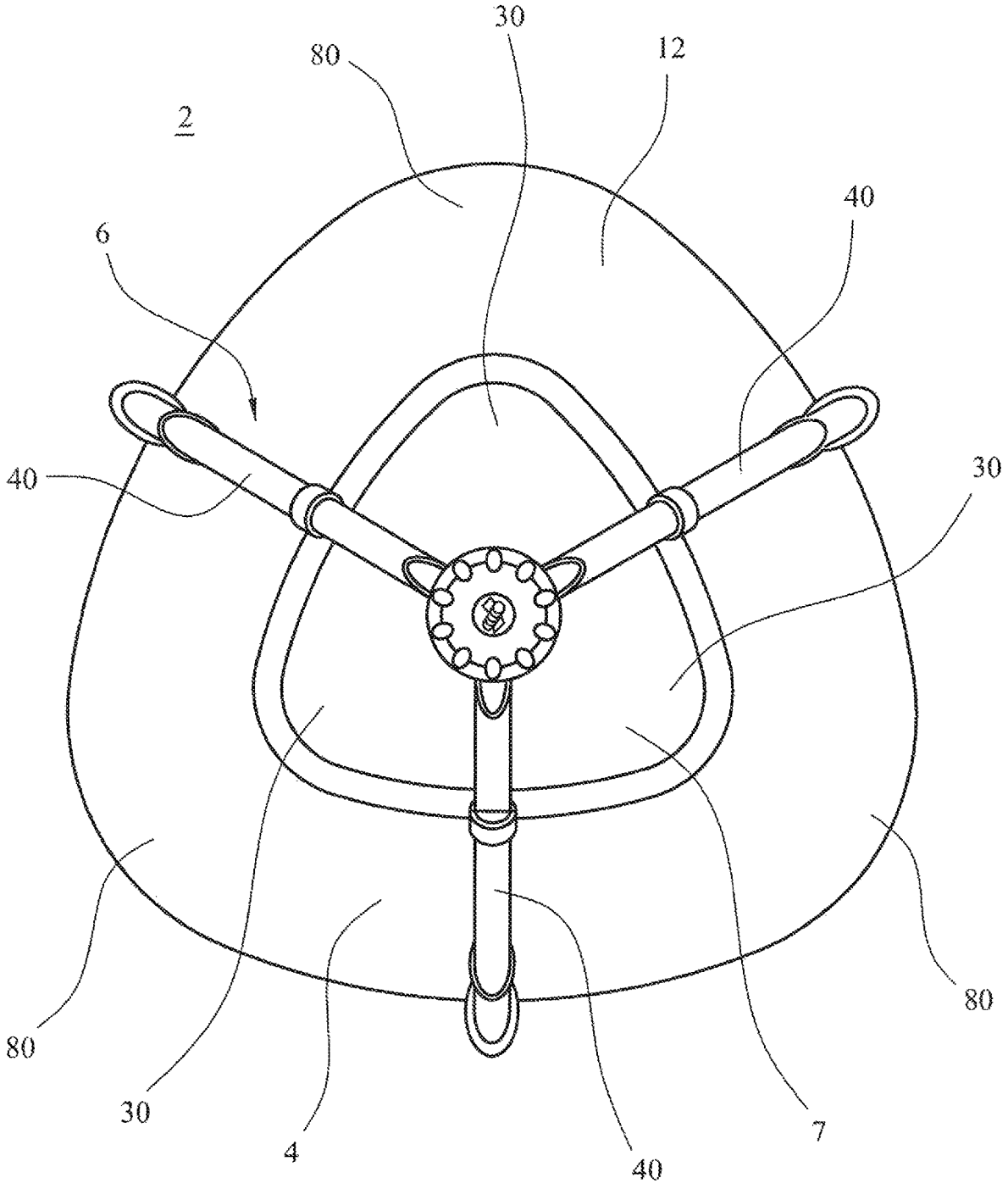
FIG. 2 is a top plan view of the apparatus of FIG. 1.

Referring to FIGS. 8 to 11, the support device 4 is shown inverted compared to its configuration shown in FIGS. 1, 2 and 5 to reveal a second infant accommodation region 50 of the apparatus 2.

The second infant accommodation region 50 is arranged to provide a safe and secure position for a baby from age 0. Region 50 includes a padded headrest 54 and a body support region 55. The headrest 54 comprises a piece of material which is sewn to the fabric 34 of the cover 12. It includes a circular region 56 and, extending there around, a padded region 58 (shown hatched in FIG. 8) which includes wadding so that region 58 extends outwardly away from circular region 56 to provide support for an infant's head which may rest upon circular region 56. Body support region 55 comprises a piece of material which is also sewn to the fabric 34 of the cover 12 and is padded (as shown hatched in FIG. 8). Towards one side of region 52, a harness 60 is provided and arranged to receive a baby's legs, through leg openings 61, so that elongate portion 62 is arranged around a baby's waist and/or hips in use. Firstly, when the device is inverted as shown in FIGS. 8 to 11, padded base 14 may fall away slightly from fabric 34 which in the FIGS. 1, 2, and 5 arrangements directly contacts the ground on which the support device 4 rests.

Advantageously, the headrest 54 is positioned radially inwards of one apex region 21 (i.e. radially inwards of a region of enclosure wall 10 which has the lowest radius of curvature). This enables the baby's shoulders to rest on the widest part of enclosure wall 10. This arrangement provides a well-supported snug position for the baby.

Advantageously, the headrest 54 and body support region 35 are sufficiently compact and compressible that they can be permanent features of the apparatus, even when the apparatus is used in the FIGS. 1, 2 and 5 positions. Thus, the headrest 54 does not need to be removable. Similarly, harness 60 can be a permanent fixture which is suitably sufficiently soft that it doesn't interfere with the apparatus when used in the FIGS. 1, 2 and 5 positions.

In use, a baby can be placed on region 55, with its head resting in region 56 of headrest 54 and safely secured in position by engagement with harness 60. In this case, there is suitably a small amount of "give" associated with region 55 and underlying fabric 54, so a slightly bowl-shaped or concave region is defined in which the baby can comfortably lie.

The infant accommodation apparatus may be used alone or may be used with the framework 6 extending over the device. Various different types of frameworks may be utilized. One type may be as shown in FIGS. 1 and 2. A preferred infant accommodation apparatus incorporating a framework is shown in FIGS. 12 to 14.

Figure 12:
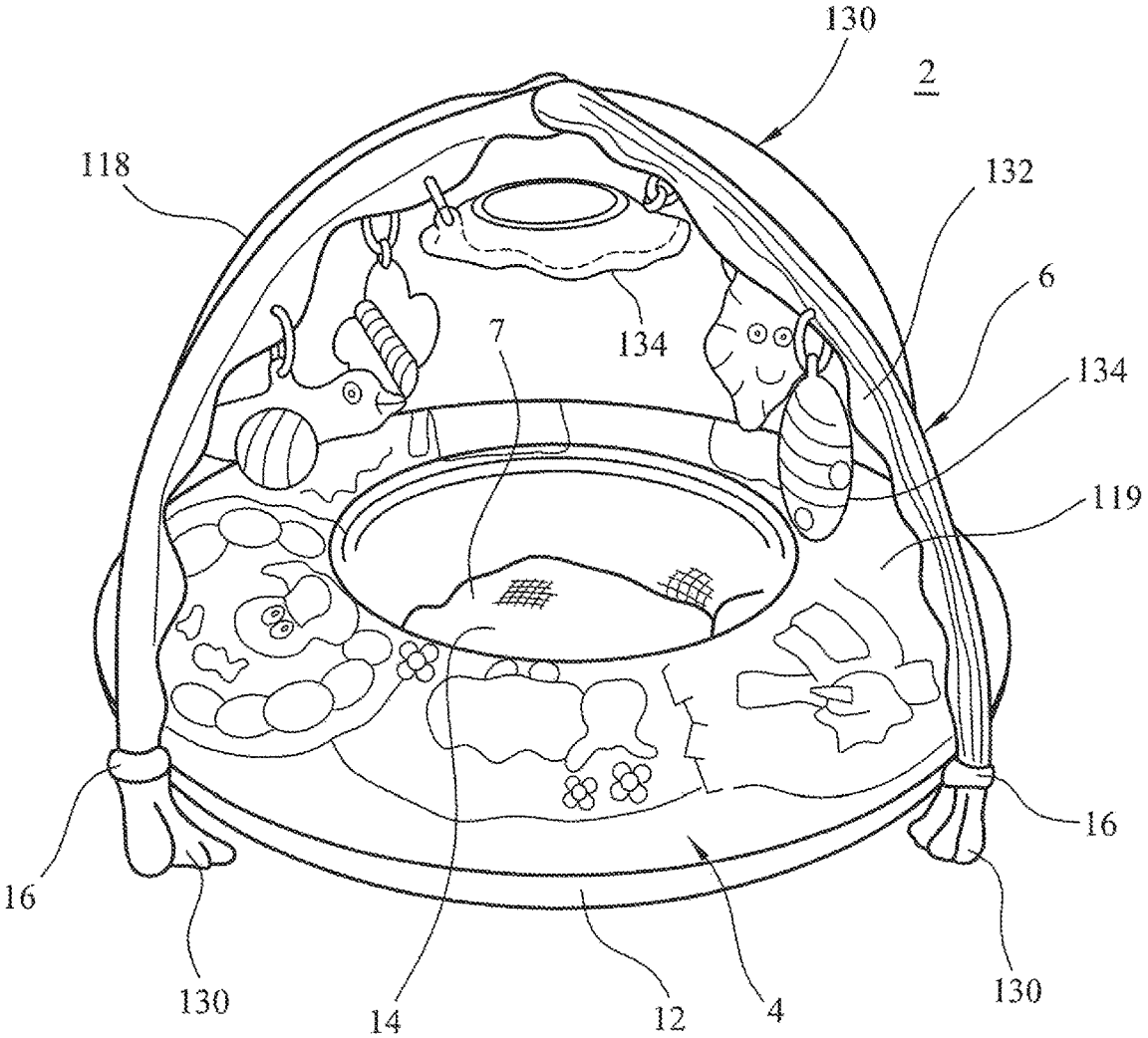
FIG. 12 is a front view of a second embodiment of an infant accommodation apparatus with a framework.
Figure 13:
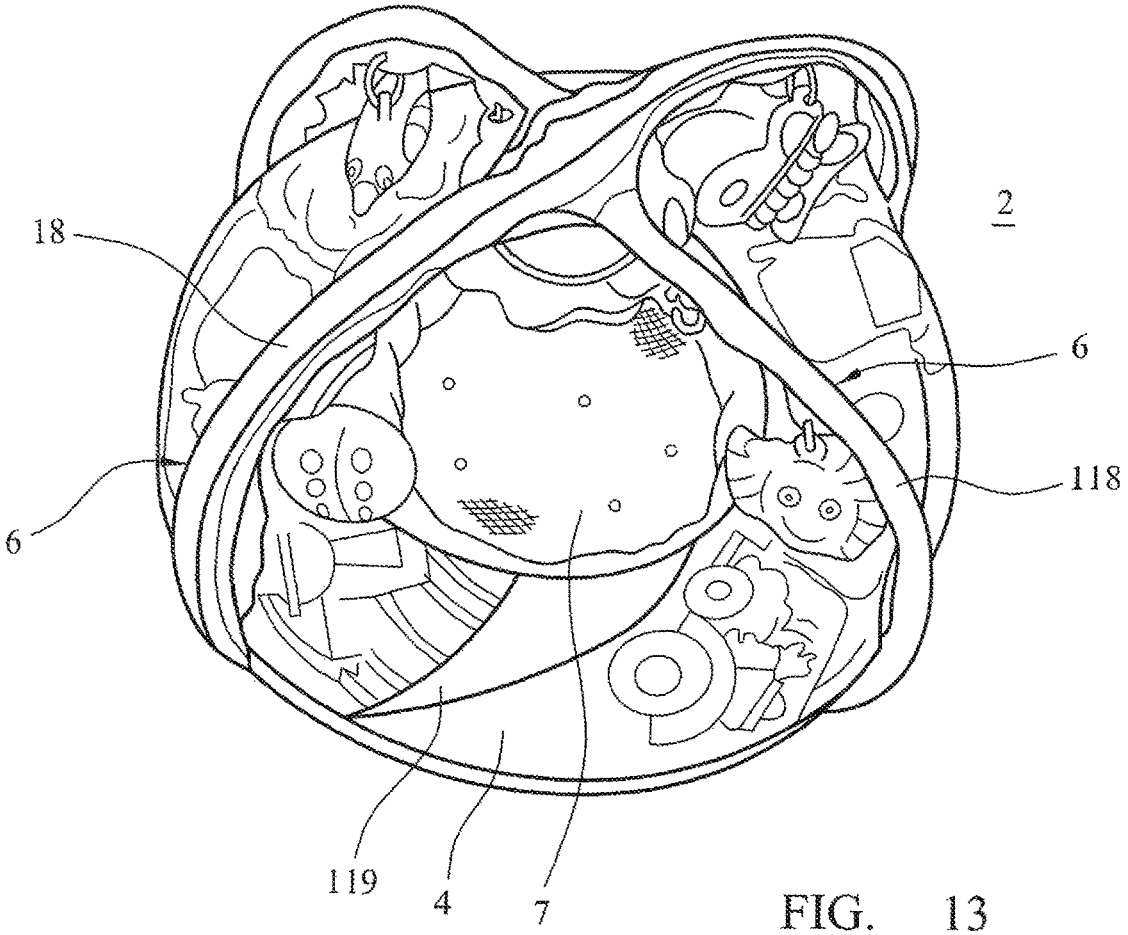
FIG. 13 is a top plan view of the apparatus of FIG. 12.
Figure 14:
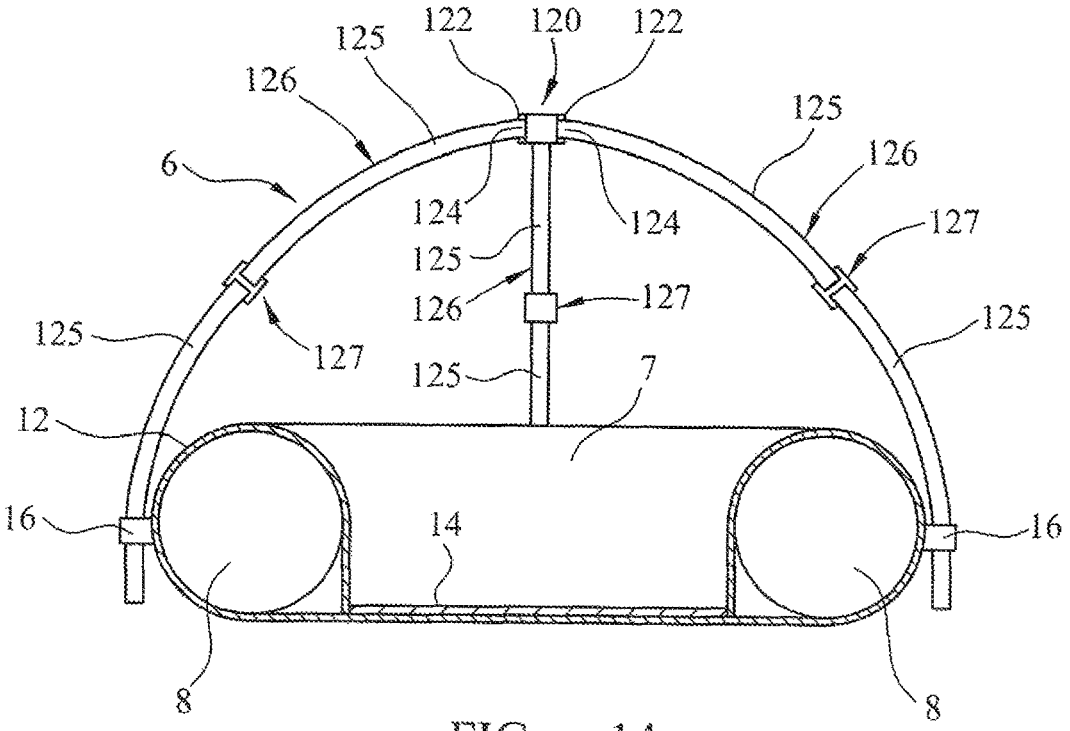
FIG. 14 is a vertical cross-section through the apparatus of FIGS. 12 and 13 with a fabric cover of the apparatus omitted in the interests of clarity.

Referring to FIGS. 12 to 14, four elastic loops 16 are incorporated into the fabric cover 12 and spaced at 90° intervals around the periphery of the cover at a level which is approximately midway between the upper and lower walls of the device 4. The loops are arranged to resiliently engage members 118 of the framework 6.

Generally upwardly facing outer surface 119 of the cover is highly decorated and provided with various means for stimulating the senses of an infant. For example, the cover may be visually stimulating by incorporating representations in bright and contrasting colours; it may stimulate the tactile sense by incorporating materials of different textures; and it may stimulate the auditory sense by incorporating means for causing squeaks or crinkle sounds or electronic devices for playing melodies or making other noises.

Framework 6 is arranged to provide a dome-shaped structure over the device 4 and comprises a cruciform connector 120 which includes outwardly facing ports 122 which are spaced at 90° to one another and are arranged to slidably receive ends 124 of arcuate tubular struts 126. Each strut 126 has two strut parts 125 connected by a female connector 127. The framework 6 is provided with a one piece removable fabric cover 130 which encloses each strut 126 and connector 120. The cover comprises a first sleeve which is arranged to cover one pair of diametrically extending struts 126 and two other sleeves extending perpendicular to the first sleeve and stitched thereto for covering the other two struts. Access to the cover is obtained via an opening facing downwardly in use in the region of the cover which accommodates the cruciform connector.

The framework 6 is assembled by inserting each strut in position in the sleeves of the cover and then inserting connector 120 into the cover via the downwardly facing opening described and securing the struts to the connector.

The cover 130 is brightly coloured and it includes scalloped areas 132 which incorporate buttonholes to which toys 134 can be releasably secured.

Framework 6 with cover 130 in position can be releasably secured to the support device 4 with the support device positioned with its fabric 134 of its base on the ground by pushing the fabric covered struts 126 through loops 16 until the struts are adjacent the floor on which the apparatus is supported. The struts and, therefore, the framework 6, are retained in position by virtue of the friction between the fabric of the framework and loops 16 and the force exerted by the resilient loops.

In addition to the framework being securable in position as shown in FIGS. 12 to 14, the framework may, in view of the positioning and arrangement of loops 16, also be secured in position when the support device is inverted as represented in FIGS. 8 to 11.

Thus, the apparatus may advantageously be used in a number of configurations to accommodate and/or stimulate a baby/infant from age 0 up to about 3 or 4 years, as follows:

(i) From age 0, the plastics member 8 may be substantially fully inflated and, with the apparatus inverted, as represented in FIGS. 8 to 11, the baby may be secured in the harness 60 with its head resting on circular region 56 of headrest 54. In this position, the baby is in a very safe and secure environment. The baby cannot become dislodged from its position in the harness or tip the apparatus over.

(ii) For added stimulation of the baby when the apparatus is arranged as described in configuration (i), the framework 6 described in FIGS. 12 to 14 may be positioned as described.

(iii) Once the baby has outgrown the configurations described in (i) and (ii), the apparatus may be turned over and the position shown in FIGS. 1, 2 and 5 adopted. In this case, an infant may sit or kneel in the infant accommodation region.

(iv) For added stimulation of the infant when arranged in configuration (iii), the apparatus may be further provided with the framework 6 described in FIGS. 12 to 14.

Thus, the apparatus described can provide a safe, stimulating environment for a baby/infant for many years.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An infant accommodation apparatus comprising a support device which includes a base, said support device including an enclosure extending away from said base on a first side of the base, wherein said enclosure surrounds an infant accommodation region in which an infant may be positioned in use and wherein a headrest is provided on a second side of the base, wherein said infant accommodation apparatus is arranged to be positioned in a first configuration wherein the base directly contacts and/or is supported by a support surface and said enclosure extends away from said base on said first side of the base wherein:

(i) said apparatus is arranged in said first configuration, said headrest faces downwardly; and/or (ii) said apparatus is arranged in said first configuration, said headrest directly contacts a support surface on which the infant accommodation apparatus is arranged, in use; and wherein a harness is provided on said second side of the base for securing an infant to the support device, wherein, when said apparatus is in said first configuration and wherein said headrest faces downwardly, said harness faces downwardly.

2. An apparatus accordingly to claim 1, wherein said enclosure is defined by an inflated member which inflated member can be deflated; wherein said support device is arranged to define an endless enclosure around the region for accommodating an infant; and wherein said support device incorporates a cover which is removable from an insert member of the device.

3. An apparatus according to claim 1, wherein said headrest includes a first part which is arranged to contact and/or seat the back of an infant's head, in use.

4. An apparatus according to claim 3, wherein said headrest is superimposed on a region of the support device which is outside an area occupied by the infant accommodation region.

5. An apparatus according to claim 1 wherein in said first configuration, said harness directly contacts a support surface on which the infant accommodation apparatus is arranged in use.

6. An apparatus according to claim 1, wherein said support device includes a cover and said harness is secured to the cover.

7. An apparatus according to claim 6, wherein said harness is superimposed on the infant accommodation region of the support device.

8. An apparatus according to claim 1, wherein said infant accommodation apparatus is arranged to be positioned in a second configuration which is inverted relative to said first configuration, wherein, when in said second configuration, said headrest faces upwardly.

9. An apparatus according to claim 8, wherein said support device includes an infant support part which defines an area for supporting an infant's body when the support device is in said second configuration, wherein said infant support part comprises a shaped material secured relative to a cover of the apparatus, wherein said support is arranged such that, when in second configuration with an infant contacting said infant support part, a concave region is defined in which the infant can lie.

10. An infant accommodation apparatus comprising a support device which includes a base, said support device including an enclosure extending away from said base on a first side of the base, wherein said enclosure surrounds an infant accommodation region in which an infant may be positioned in use and wherein a headrest is provided on a second side of the base, wherein said headrest is positioned between parts of inner and outer enclosure walls of said support device which have a greater radius of curvature than other parts of the inner and outer enclosure walls.

11. An apparatus according claim 10, wherein said inner enclosure wall includes a first region which has a smaller radius of curvature than respective second and third regions of said inner enclosure walls adjacent to said first region; and said outer enclosure wall includes a first region which has a smaller radius of curvature than respective second and third regions; and said headrest is positioned between said second region of said inner enclosure wall and a second region of said outer enclosure wall.

12. An apparatus according to claim 10, wherein when said support device includes a harness, said harness is positioned in line with parts of the inner and outer enclosure walls which have a small radius of curvature than other parts of the inner and outer enclosure walls.

13. An apparatus according to claim 11, wherein said inner enclosure wall includes a fifth region, adjacent the third region, which has a radius of curvature which is less than that of a third region of the inner enclosure wall; and includes an outer enclosure wall which includes a fifth region, adjacent the third region, which has a radius of curavature which is less than that of the third region of the outer enclosure wall, wherein said harness is positioned in line with the fifth regions of the inner and outer enclosure walls.

14. An apparatus according to claim 8, wherein said infant accommodation apparatus includes a frame extending above the support device for visually stimulating an infant positioned in the support device, wherein said support device includes first securement means for securing said frame in position, wherein said first securement means is arranged on an outwardly facing surface of the support device, wherein said first securement means is arranged to releasably engage the frame when the infant accommodation apparatus is in said first configuration and also when it is in said second configuration.

15. An infant accommodation apparatus comprising a support device which includes a base, said support device including an enclosure extending away from said base on a first side of the base, wherein said enclosure surrounds an infant accommodation region in which an infant may be positioned in use and wherein a headrest is provided on a second side of the base, wherein said headrest includes a first part which is arranged to contact and/or seat the back of an infant's head, in use, wherein the first part has a curved outer perimeter, wherein the headrest includes a proud region which extends around the first part and is arranged to restrict side to side movement of the infant's head in use.

16. An infant accommodation apparatus comprising a support device which includes a base, said support device including an enclosure extending away from said base on a first side of the base, wherein said enclosure surrounds an infant accommodation region in which an infant may be positioned in use and wherein a headrest is provided on a second side of the base; wherein said infant accommodation apparatus is arranged to be positioned in a first configuration wherein the base directly contacts and/or is supported by a support surface and said enclosure extends away from said base on said first side of the base wherein, when said apparatus is arranged in said first configuration, said headrest faces downwardly; wherein said enclosure is defined by means of an inflated member which inflated member can be deflated, wherein said support device is arranged to define an endless enclosure around the region for accommodating an infant and wherein said support device incorporates a cover which is removable from an insert member of the device; wherein a harness is provided on a second side of the base for securing an infant to the support device, wherein, when said apparatus is in said first configuration wherein said headrest faces downwardly, said harness faces downwardly; wherein said support device includes a cover and a said harness is secured to the cover; wherein said infant accommodation apparatus includes a frame extending above the support device for visually stimulating an infant positioned in the device, wherein said support device includes first securement means for securing said frame in position, wherein said first securement means is arranged on an outwardly facing surface of the support device, wherein said first securement means is arranged to releasably engage the frame when the infant accommodation apparatus is in said first configuration and when it is in said second configuration.

* * * * *